US011122913B2

(12) United States Patent
Tuckey

(10) Patent No.: US 11,122,913 B2
(45) Date of Patent: Sep. 21, 2021

(54) BASSINET LOCKING MECHANISM, BASSINET RELEASING MECHANISM, FOLDABLE BASSINET APPARATUS

(71) Applicant: Wonderland Switzerland AG, Steinhausen (CH)

(72) Inventor: Peter R. Tuckey, Leola, PA (US)

(73) Assignee: Wonderland Switzerland AG, Steinhausen (CH)

( * ) Notice: Subject to any disclaimer, the term of this patent is extended or adjusted under 35 U.S.C. 154(b) by 648 days.

(21) Appl. No.: 15/980,708

(22) Filed: May 15, 2018

(65) Prior Publication Data

US 2018/0360230 A1 Dec. 20, 2018

Related U.S. Application Data

(60) Provisional application No. 62/519,584, filed on Jun. 14, 2017, provisional application No. 62/545,001, filed on Aug. 14, 2017.

(51) Int. Cl.
*A47D 9/00* (2006.01)

(52) U.S. Cl.
CPC ..... *A47D 9/005* (2013.01)

(58) Field of Classification Search
CPC ..... A47D 9/005; A47D 7/002; A47D 13/063
See application file for complete search history.

(56) References Cited

U.S. PATENT DOCUMENTS

| | | | | | |
|---|---|---|---|---|---|
| 322,947 | A * | 7/1885 | Marzergue | A47D 9/005 | 5/98.3 |
| 329,016 | A * | 10/1885 | Clark | A47D 7/002 | 5/99.1 |
| 823,321 | A * | 6/1906 | Dejonge | A47D 9/005 | 5/98.3 |
| 914,309 | A * | 3/1909 | Ross | A47D 9/005 | 5/98.2 |
| 1,176,926 | A * | 3/1916 | Pocock | A47C 17/64 | 5/113 |

(Continued)

FOREIGN PATENT DOCUMENTS

| | | |
|---|---|---|
| CN | 204708435 U | 10/2015 |
| CN | 107374169 A | 11/2017 |

(Continued)

*Primary Examiner* — Eric J Kurilla
(74) *Attorney, Agent, or Firm* — Winston Hsu

(57) ABSTRACT

A foldable bassinet apparatus includes a bassinet locking mechanism and a bassinet releasing mechanism. The bassinet releasing mechanism is used to actuate the bassinet locking mechanism. The bassinet locking mechanism includes a first hinge component, a second hinge component, an outer capping component and a locking hub component. The second hinge component is rotatably connected to the first hinge component. The outer capping component is rigidly connected to the second hinge component and configured to cap the first hinge component. The locking hub component is slidably located between the first hinge component and the outer capping component. The locking hub component is fully retracted into the first hinge component to allow relative rotation between the first hinge component and the second hinge component, and is further partially protruded from the first hinge component to constrain the relative rotation.

12 Claims, 19 Drawing Sheets

(56) References Cited

U.S. PATENT DOCUMENTS 2,525,168 A * 10/1950 Dodge ..... A47D 9/005 5/98.2
2,916,744 A * 12/1959 May ..... A47D 9/005 5/102
3,146,736 A * 9/1964 Hetrick ..... A47D 9/005 108/176
3,839,754 A * 10/1974 Hooper ..... A47D 7/002 5/98.2
4,192,480 A * 3/1980 Schmidt ..... A47B 3/12 108/173
4,483,026 A 11/1984 Kassai
5,193,234 A * 3/1993 Joaquin ..... A47D 7/002 5/99.1
5,381,570 A 1/1995 Cheng
5,511,441 A 4/1996 Arai
5,711,040 A 1/1998 Huang
5,802,635 A * 9/1998 Chen ..... A47D 9/005 5/102
6,343,390 B1 2/2002 Yang
6,385,800 B1 5/2002 Chen
6,687,928 B1 * 2/2004 Wilson ..... A47D 7/002 403/59
6,948,197 B1 9/2005 Chen
9,155,402 B1 * 10/2015 Whitman ..... A47D 7/002
D770,213 S * 11/2016 Bellows ..... D6/718
9,534,628 B1 1/2017 Wang
9,883,750 B2 * 2/2018 Yi ..... A47D 9/00
10,154,737 B2 * 12/2018 Horst ..... A47D 9/00
D877,527 S * 3/2020 Gopaul ..... D6/390
2002/0084626 A1 7/2002 Ageneau
2004/0133977 A1 * 7/2004 Rimbau Vidal ..... A47D 9/005 5/98.3
2005/0150046 A1 7/2005 Gehr
2006/0021136 A1 * 2/2006 Cheng ..... A47D 7/002 5/99.1
2008/0034497 A1 * 2/2008 Cheng ..... A47D 13/063 5/99.1
2011/0148155 A1 * 6/2011 Chapman ..... A47D 9/02 297/16.1
2013/0214574 A1 * 8/2013 Chapman ..... A47D 13/00 297/258.1
2013/0333111 A1 12/2013 Cheng
2014/0014791 A1 * 1/2014 Shan ..... F16C 11/10 248/188.7
2014/0070590 A1 3/2014 Zhong
2015/0216321 A1 * 8/2015 Hartenstine ..... A47D 7/04 5/11
2015/0216322 A1 * 8/2015 Longenecker ..... A47D 9/005 5/99.1
2016/0198864 A1 * 7/2016 Yang ..... A47D 15/00 5/655
2017/0065097 A1 * 3/2017 Chen ..... A47D 9/02
2018/0192786 A1 * 7/2018 Horst ..... A47D 7/007
2018/0206652 A1 * 7/2018 Gallina ..... A47D 9/04
2018/0303250 A1 * 10/2018 Mountz ..... A47D 13/063
2019/0045944 A1 * 2/2019 Yang ..... A47D 7/002
2019/0261783 A1 * 8/2019 Mountz ..... A47D 13/063
2020/0352351 A1 * 11/2020 Mountz ..... A47D 9/005

FOREIGN PATENT DOCUMENTS

EP 0 494 701 A2 7/1992
GB 2 380 520 A 4/2003
GB 2517061 A 2/2015
NL 1018648 C 2/2003

* cited by examiner

BASSINET LOCKING MECHANISM, BASSINET RELEASING MECHANISM, FOLDABLE BASSINET APPARATUS

CROSS REFERENCE TO RELATED APPLICATIONS

This application claims the benefit of U.S. provisional application No. 62/519,584 (which was filed on Jun. 14, 2017), and U.S. provisional application No. 62/545,001 (which was filed on Aug. 14, 2017). The disclosures of the prior applications are incorporated herein by reference herein in their entirety.

BACKGROUND OF THE INVENTION

1. Field of the Invention

The present invention relates to a bassinet locking mechanism, a bassinet releasing mechanism and a related foldable bassinet apparatus, and more particularly, to a bassinet locking mechanism and a bassinet releasing mechanism capable of being easily folded and unfolded and a related foldable bassinet apparatus utilizing the bassinet releasing mechanism to actuate functions of the bassinet locking mechanism.

2. Description of the Prior Art

A conventional play yard provides an enclosed region where a child can play and sleep inside, and a bassinet can be put on top rails of the play yard or installed inside the play yard for the child from newborn to one year old. The conventional play yard is unnecessarily large and has complicated operating procedure when the play yard is folded and unfolded for storage. Therefore, design of an apparatus capable of supporting the bassinet and having convenient folding and unfolding functions is an important issue in the related industry.

SUMMARY OF THE INVENTION

The present invention provides a bassinet locking mechanism and a bassinet releasing mechanism capable of being easily folded and unfolded and a related foldable bassinet apparatus utilizing the bassinet releasing mechanism to actuate functions of the bassinet locking mechanism for solving above drawbacks.

According to the claimed invention, a foldable bassinet apparatus includes a center tube, at least two frames and at least two connection modules. Each connection module is disposed on one of two frames, and the center tube is connected between the connection modules. The at least one of the connection modules includes a bassinet locking mechanism. When the bassinet locking mechanism is unlocked, the center tube is able to move upward and the foldable bassinet apparatus moves from an unfolding position to a folding position. The connection modules include a first tube and a second tube. The bassinet locking mechanism includes a first hinge component fixed to the first tube, a second hinge component fixed to the second tube and rotatably connected to the first hinge component, and a locking hub component disposed on the center tube and slidably located between the first hinge component and the second hinge component. The first hinge component has a penetrating hole where the center tube passes through. The locking hub component is fully retracted into the first hinge component to allow relative rotation between the first hinge component and the second hinge component for folding and unfolding the foldable bassinet apparatus, and is further partially protruded from the first hinge component to constrain the relative rotation for locking modes of the foldable bassinet apparatus.

According to the claimed invention, first hinge component includes at least one first tooth, and the second hinge component includes at least one second tooth, and the locking hub component includes at least one third tooth engaged between the at least one first tooth and the at least one second tooth to constrain the relative rotation. While the locking hub component is fully retracted into the first hinge component, the at least one third tooth is disengaged from the second tooth, allowing the relative rotation between the first hinge component and the second hinge component for folding and unfolding the foldable bassinet apparatus; and while the locking hub component is partially protruded from the first hinge component, the at least one third tooth is engaged with the first tooth and the second tooth to constrain the relative rotation for locking modes of the foldable bassinet apparatus. The bassinet locking mechanism further includes a resilient component disposed between the first hinge component and the locking hub component, and a resilient recovering force of the resilient component is used to move the locking hub component toward the second hinge component. The resilient component is a compressed spiral spring, an end of the compressed spiral spring abuts against an inner surface of the first hinge component, and the other end of the compressed spiral spring is disposed on a protruding body of the locking hub component.

According to the claimed invention, the center tube includes a bassinet releasing mechanism connected to the bassinet locking mechanism. The bassinet releasing mechanism includes a pull wire located inside the center tube, and a releasing component jointed with the other end of the pull wire. An end of the pull wire is jointed with the locking hub component. The releasing component is actuated to pull the locking hub component via the pull wire to retract the locking hub component into the first hinge component. The bassinet releasing mechanism further includes a handle and a pressing component, and the handle is disposed on the center tube. The pressing component is movably disposed on the handle and configured to drive motion of the releasing component. The releasing component is a rotary plate rotatably disposed on the handle and contacting against the pressing component. The releasing component includes a handle and a bushing portion connected with each other, and the bushing portion is slidably disposed on the center tube, and an opening is formed on the bushing portion and a rib portion is disposed adjacent by the opening, and the pull wire is locked with the opening and abuts against the rib portion. The locking hub component includes a main body, a protruding body and a retaining rib. The protruding body and the retaining rib are respectively disposed on a first surface and a second surface of the main body opposite to each other. The pull wire passes through a channel formed between the main body and the protruding body, and is reached to the second surface to abut against the retaining rib.

According to the claimed invention, a bassinet locking mechanism includes a first hinge component, a second hinge component and a locking hub component. The second hinge component is rotatably connected to the first hinge component. The locking hub component is slidably located between the first hinge component and the second hinge component. The locking hub component is fully retracted into the first hinge component to allow relative rotation between the first hinge component and the second hinge component, and is further partially protruded from the first hinge component to constrain the relative rotation. The first hinge component includes at least one first tooth, and the second hinge component includes at least one second tooth, and the locking hub component includes at least one third tooth engaged between the at least one first tooth and the at least one second tooth to constrain the relative rotation. While the locking hub component is fully retracted into the first hinge component, the at least one third tooth is disengaged from the second tooth, allowing the relative rotation between the first hinge component and the second hinge component for folding and unfolding the foldable bassinet apparatus; and while the locking hub component is partially protruded from the first hinge component, the at least one third tooth is engaged with the first tooth and the second tooth to constrain the relative rotation for locking modes of the foldable bassinet apparatus. While the second hinge component is rotated between a folding position and an unfolding position, the second hinge component is rotated relative to the first hinge component and the third tooth is not engaged with the second tooth; and while the second hinge component is rotated to the folding position and the unfolding position, the third tooth is simultaneously engaged with the first tooth and the second tooth.

According to the claimed invention, the bassinet locking mechanism further includes a resilient component disposed between the first hinge component and the locking hub component. A resilient recovering force of the resilient component is used to move the locking hub component toward the second hinge component. The resilient component is a compressed spiral spring. An end of the compressed spiral spring abuts against an inner surface of the first hinge component, and the other end of the compressed spiral spring is disposed on a protruding body of the locking hub component. The first hinge component is mounted to a tube, an end of a pull wire disposed inside the tube is jointed with the locking hub component, and the locking hub component is pulled by a releasing component via the pull wire to retract into the first hinge component. The locking hub component includes a main body, a protruding body and a retaining rib. The protruding body and the retaining rib are respectively disposed on a first surface and a second surface of the main body opposite to each other. The locking hub component further includes at least one third tooth disposed on an edge of the main body, and the at least one third tooth is configured to engage with the first hinge component and the second hinge component. An end of a pull wire passes through a channel formed between the main body and the protruding body, and is reached to the second surface to abut against the retaining rib. The second hinge component includes a hinge body and an outer capping component rigidly connected to the hinge body and configured to cap the first hinge component, and the at least one second tooth is located in the outer capping component. Further, the second hinge component includes a hinge body and an outer capping component detachably connected to the hinge body, and the at least one second tooth is located in the hinge body.

According to the claimed invention, a bassinet releasing mechanism is applied to a tube connected with a locking hub component. The bassinet releasing mechanism includes a pull wire located inside the tube, and a releasing component jointed with the other end of the pull wire. An end of the pull wire is jointed with the locking hub component. The releasing component is actuated to pull the pull wire for guiding motion of the locking hub component relative to the tube. The bassinet releasing mechanism further includes a handle disposed on the tube, and a pressing component movably disposed on the handle and configured to drive motion of the releasing component. The releasing component is a rotary plate rotatably disposed on the handle. The pressing component has a bearing surface configured to contact against a protruding portion of the releasing component. The pressing component is linearly slid relative to the handle to rotate the releasing component via contact between the bearing surface and the protruding portion.

According to the claimed invention, the releasing component includes a handle and a bushing portion connected with each other. The bushing portion is slidably disposed on the tube. An opening is formed on the bushing portion and a rib portion is disposed adjacent by the opening. The pull wire is locked with the opening and abuts against the rib portion. The handle is forced toward a direction opposite to the locking hub component for pulling the pull wire via the bushing portion. The bassinet releasing mechanism further includes a protecting component disposed on the tube, and the handle is hidden under a shield of the protecting component.

The supporting tubes of each frame of the foldable bassinet apparatus can be folded and unfolded via the connection module and the linkage mechanisms. The connection module utilizes the bassinet locking mechanism to adjust relative motion between the first tube and the second tube. The bassinet locking mechanism has the locking hub component slidably disposed between the first hinge component and the outer capping component. Rotation of the first hinge component and the second hinge component can be constrained when the locking hub component assembled with the first hinge component is further engaged with the outer capping component; in addition, the foresaid rotation can be allowed when the locking hub component is disengaged from the outer capping component. The foldable bassinet apparatus utilizes the bassinet releasing mechanism disposed on the center tube to actuate the bassinet locking mechanism. When the releasing component is operated, the releasing component can pull the locking hub component to retract into the first hinge component via the pull wire; besides, the locking hub component can be moved out of the first hinge component by the resilient component when an external force applied to the releasing component is removed. The releasing component can be directly pushed by the user or indirectly pressed via the pressing component to disengage the locking hub component from the outer capping component. The present invention, the bassinet locking mechanism and the bassinet releasing mechanism have advantages of simple structures and convenient operation, so that the related foldable bassinet apparatus can be easily folded and unfolded to minimize the volume for storage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
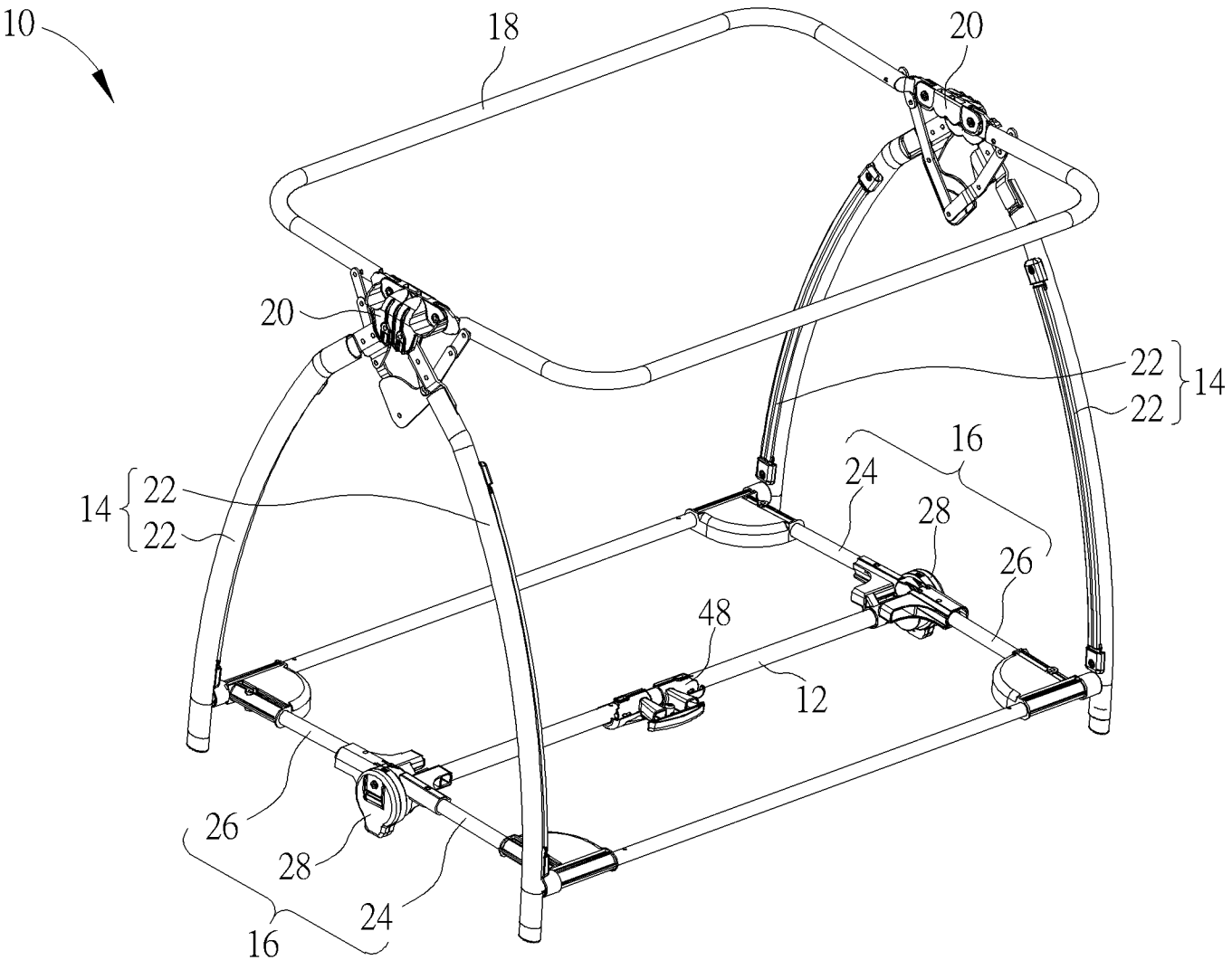
FIG. 1 and FIG. 2 are diagrams of a foldable bassinet apparatus in different operation modes according to an embodiment of the present invention.
Figure 2:
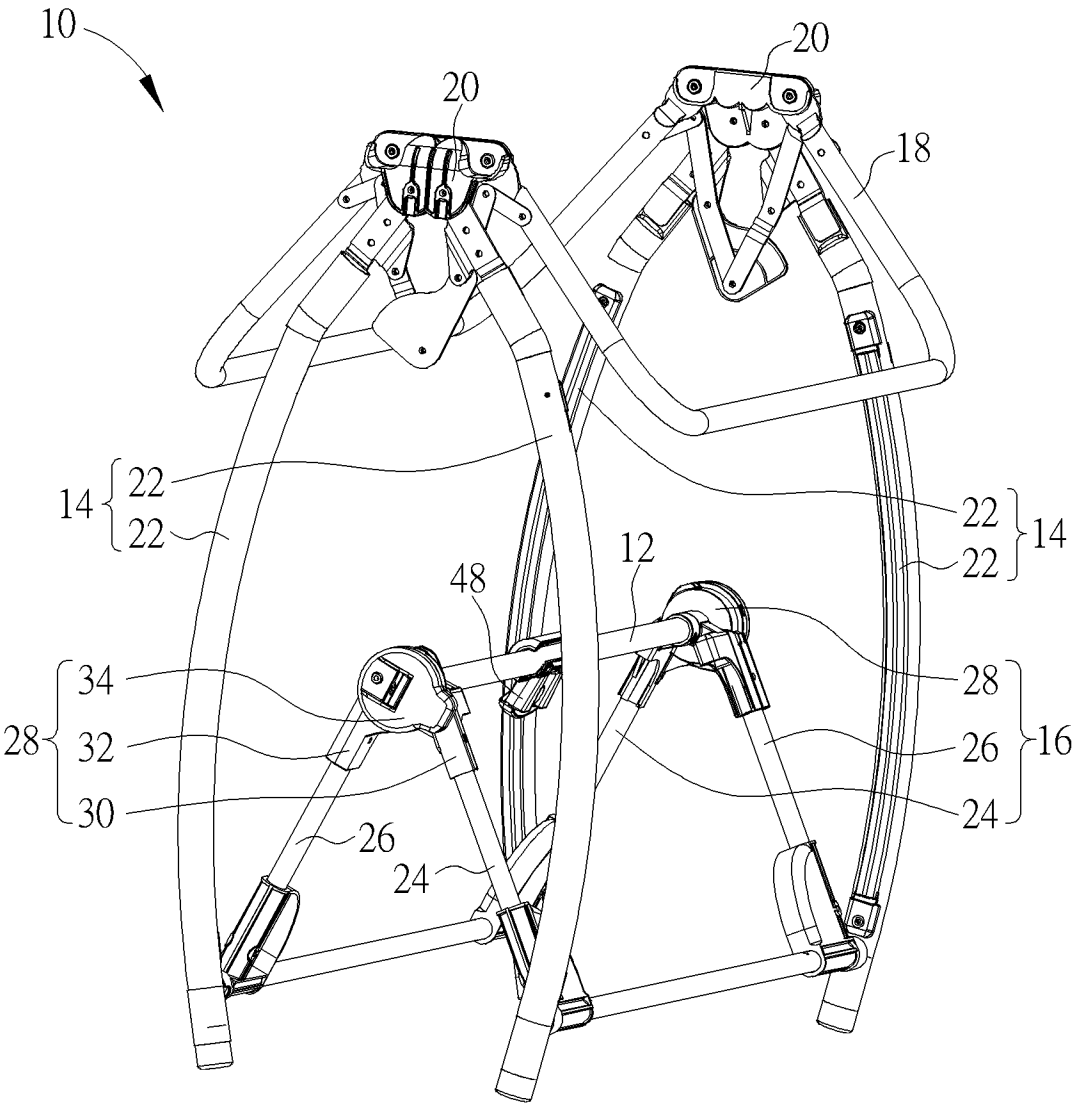

Please refer to FIG. 1 and FIG. 2. FIG. 1 and FIG. 2 are diagrams of a foldable bassinet apparatus 10 in different operation modes according to an embodiment of the present invention. The foldable bassinet apparatus 10 can include a center tube 12, two frames 14, two connection modules 16, a top rail 18, and two linkage mechanisms 20. An amount of the foresaid elements is not limited to the above-mentioned embodiment, and depends on design demand. The center tube 12 is connected between the two connection modules 16. Each frame 14 can include two supporting tubes 22 for supporting the top rail 18. Each connection module 16 is connected between the supporting tubes 22 of the corresponding frame 14, and the supporting tubes 22 can be folded and unfolded via the connection module 16. The top rail 18 is disposed on the frames 14 via the linkage mechanisms 20 and can be configured to detachably hold soft goods.

The soft goods can be a napper accessory attached to the top rail 18 and suspended above the center tube 12 for a newborn's infant. The soft goods can further be a bassinet accessory attached to the top rail 18 and positioned on the center tube 12 for a child to sleep in who may be less than five months old. Besides, the soft goods can be a mattress installed inside the top rail 18 for the child who may be up to one year old. As if the soft goods are removed, the foldable bassinet apparatus 10 can be easily folded and unfolded via utilization of the connection module 16 and the linkage mechanism 20.

The connection module 16 can include a first tube 24, a second tube 26, and a bassinet locking mechanism 28. The first tube 24 and the second tube 26 are respectively connected to the supporting tubes 22 in a rotatable manner. The bassinet locking mechanism 28 is connected between the center tube 12, the first tube 24, and the second tube 26. As shown in FIG. 1 and FIG. 2, the first tube 24 can be rotated relative to the center tube 12 in a clockwise direction, and the second tube 26 can be rotated relative to the center tube 12 in a counterclockwise direction, so that the first tube 24 and the second tube 26 can be folded for minimizing volume of the foldable bassinet apparatus 10.

Figure 3:
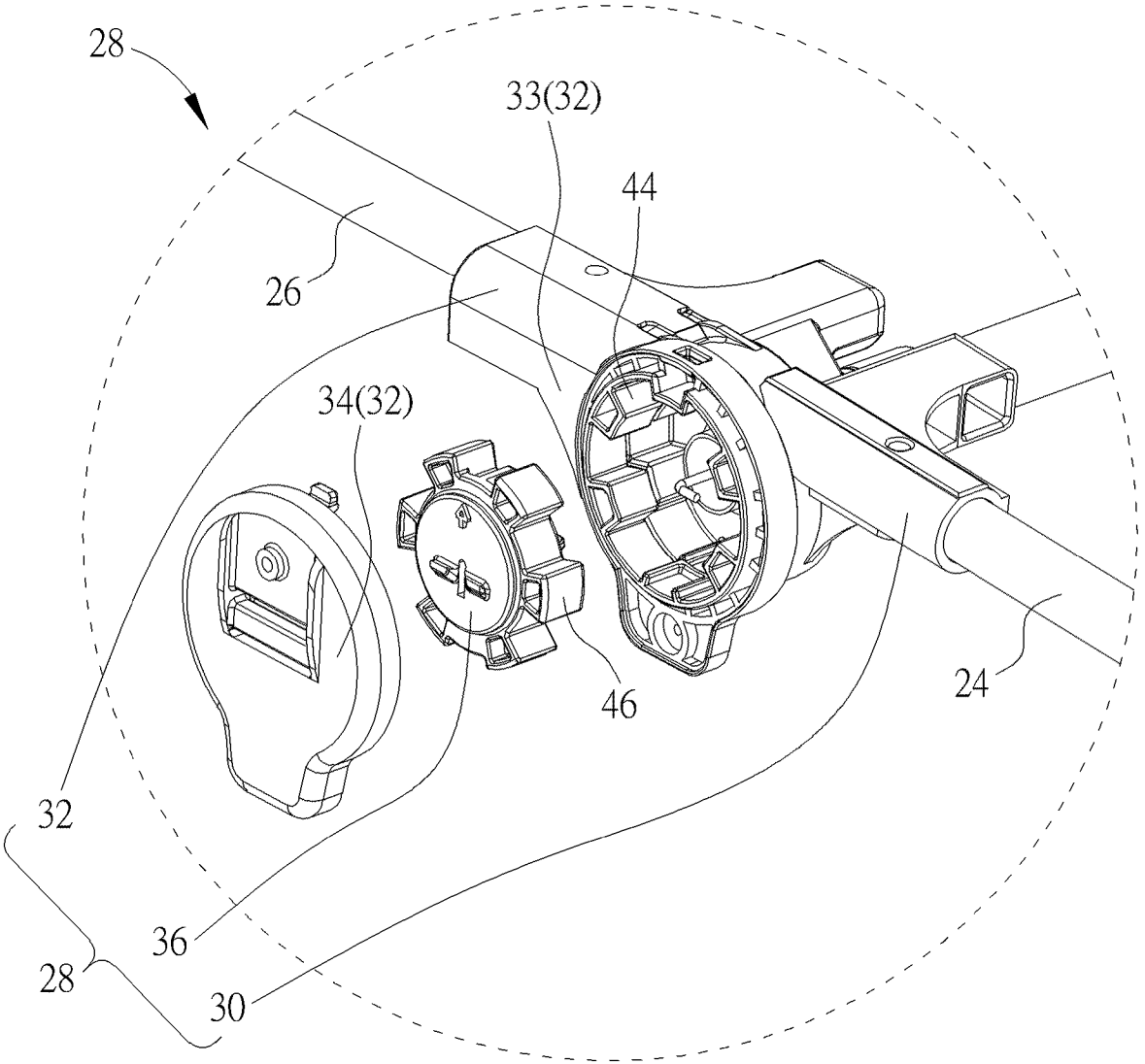
FIG. 3 and FIG. 4 are exploded diagrams of a bassinet locking mechanism in different views according to the embodiment of the present invention.
Figure 4:
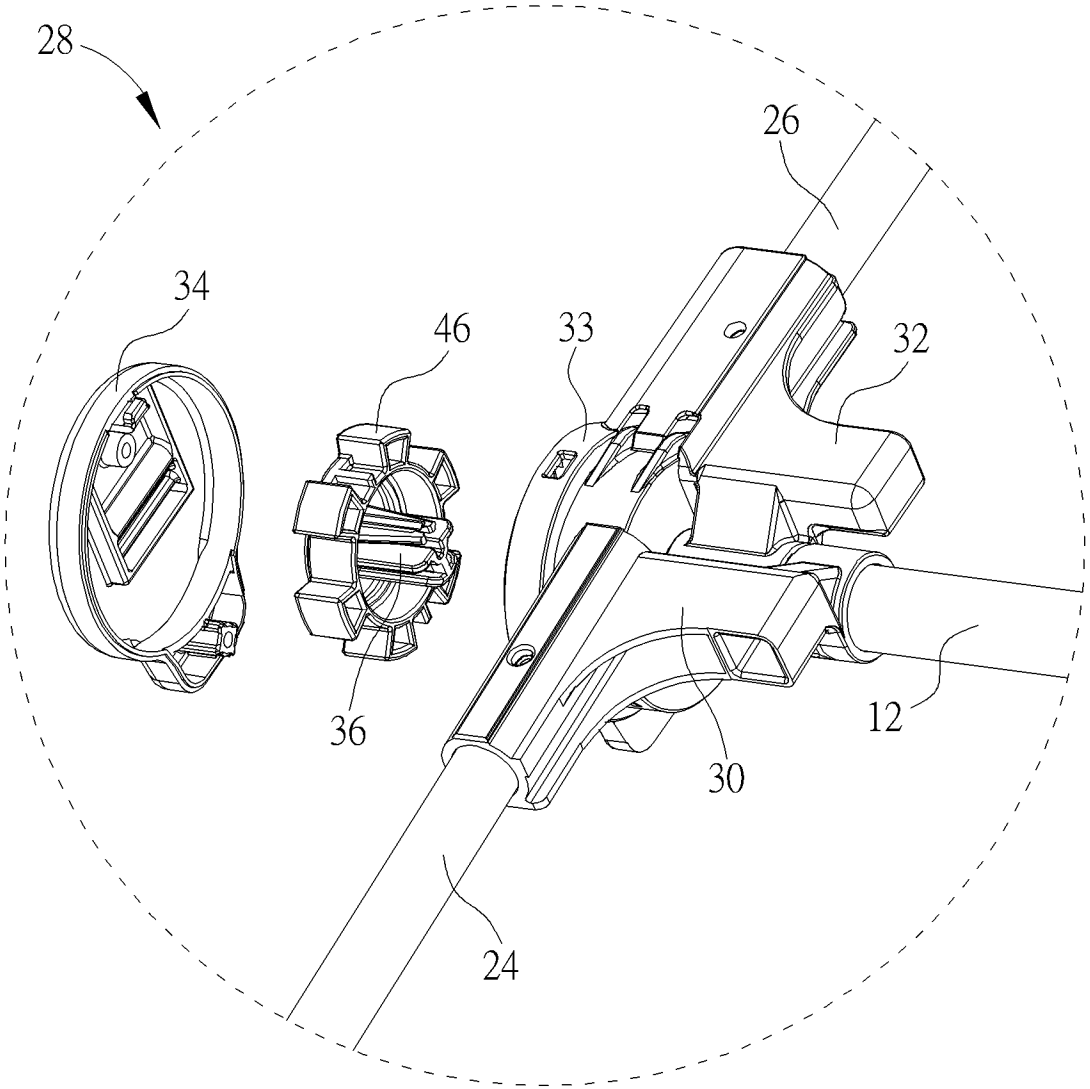
Figure 5:
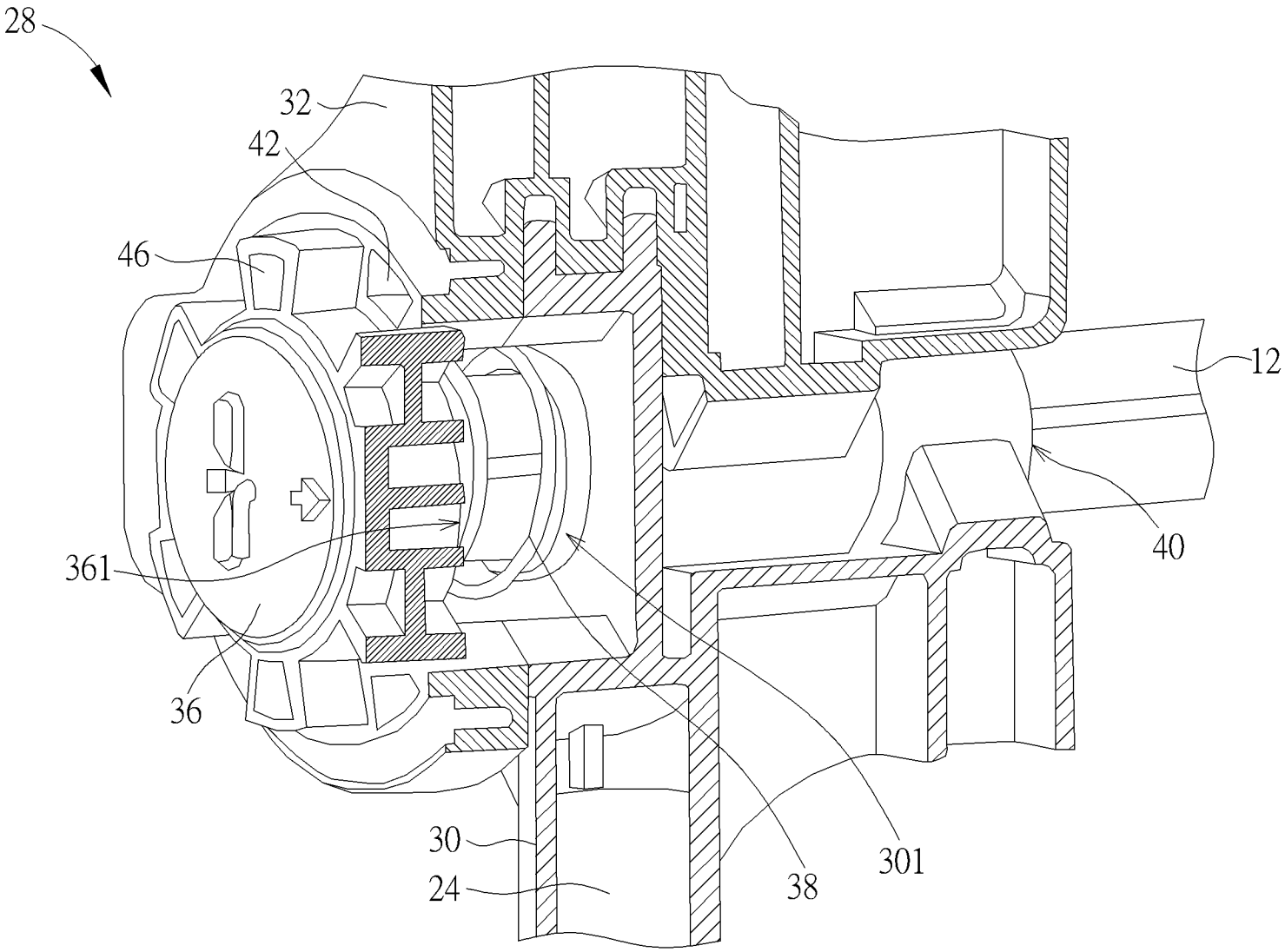
FIG. 5 is an assembly diagram of the bassinet locking mechanism according to the embodiment of the present invention.
Figure 6:
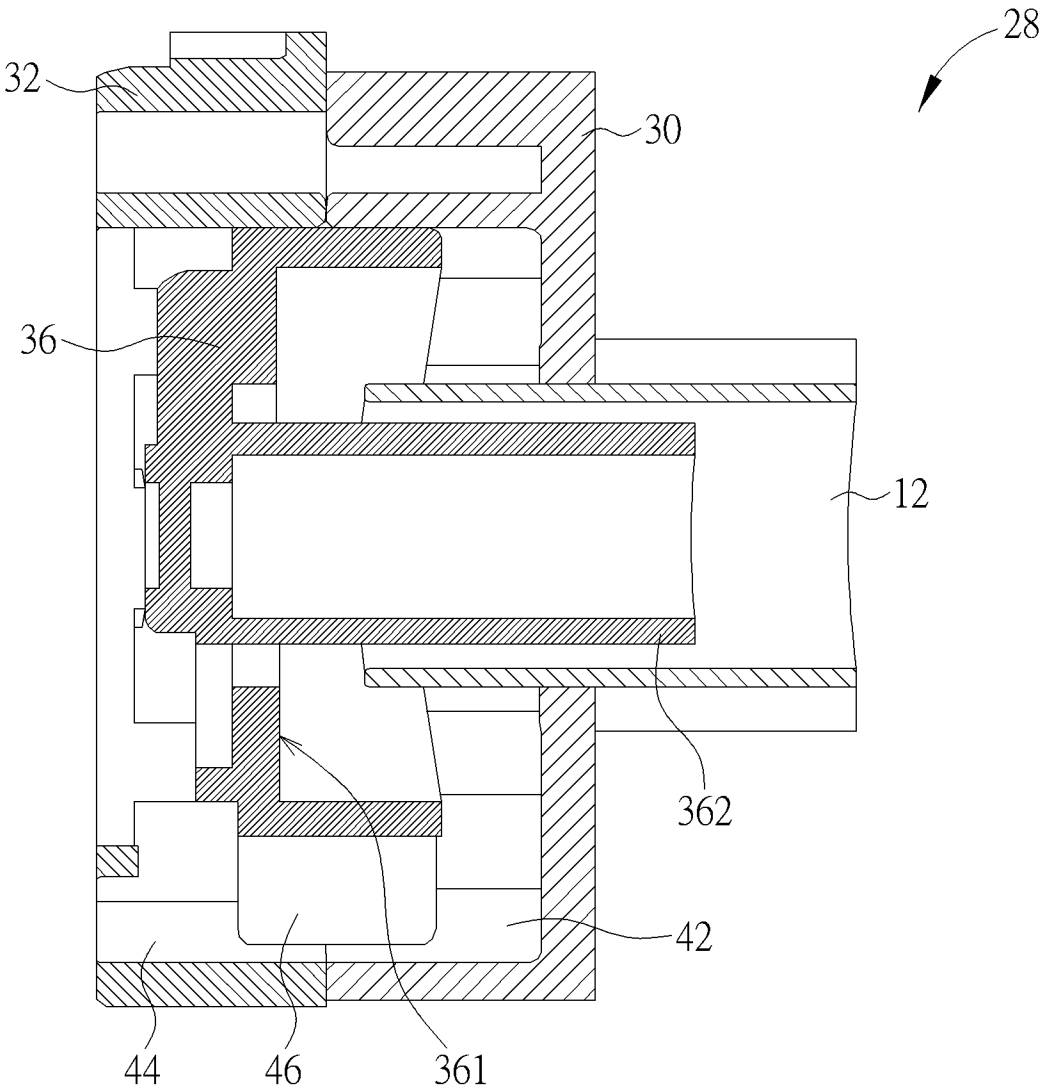
FIG. 6 and FIG. 7 are sectional views of the bassinet locking mechanism in different operation modes according to the embodiment of the present invention.
Figure 7:
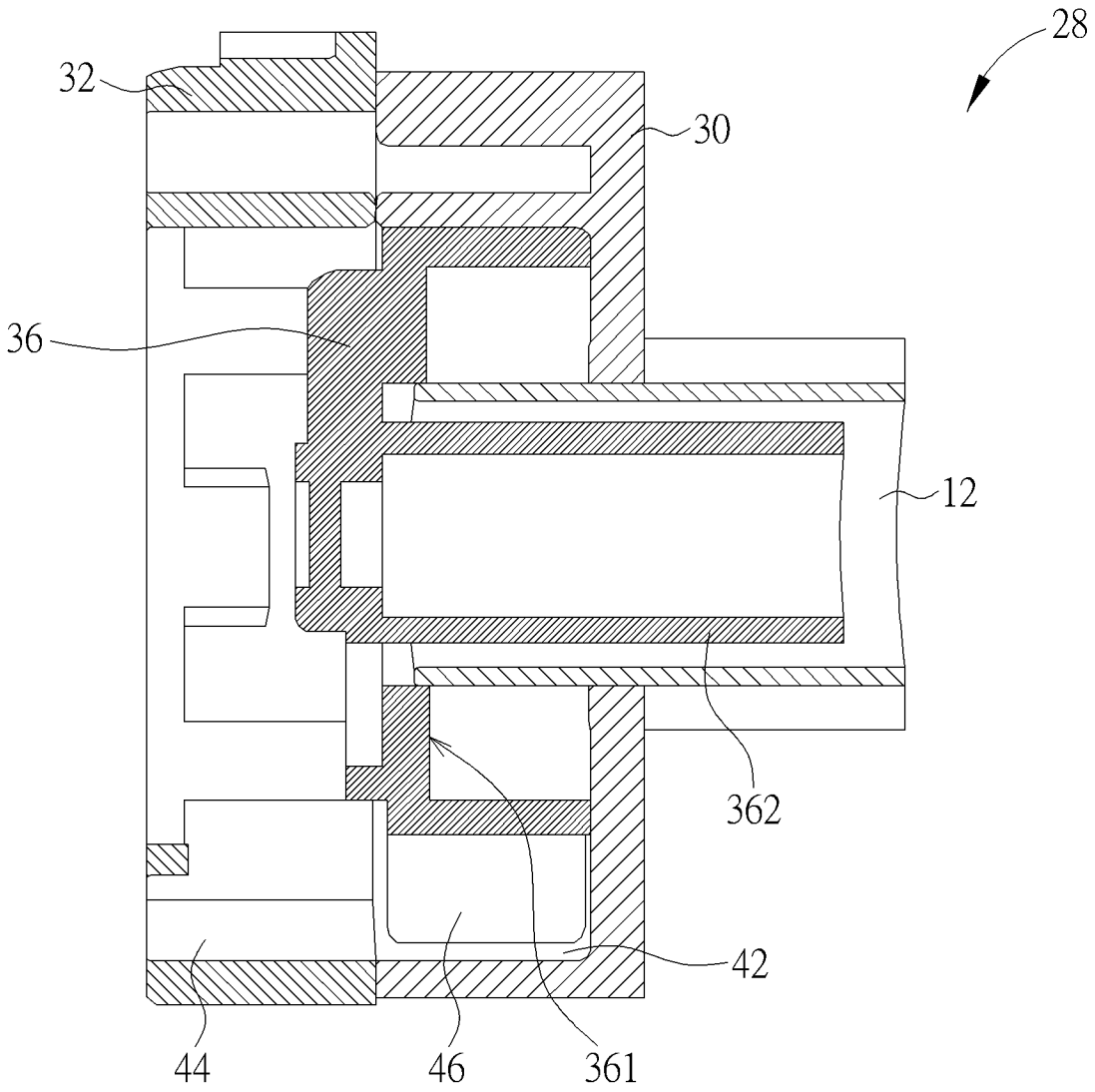

Please refer to FIG. 3 to FIG. 7. FIG. 3 and FIG. 4 are exploded diagrams of the bassinet locking mechanism 28 in different views according to the embodiment of the present invention. FIG. 5 is an assembly diagram of the bassinet locking mechanism 28 according to the embodiment of the present invention. FIG. 6 and FIG. 7 are sectional views of the bassinet locking mechanism 28 in different operation modes according to the embodiment of the present invention. The bassinet locking mechanism 28 can include a first hinge component 30, a second hinge component 32, the locking hub component 36, and a resilient component 38. The second hinge component 32 can include a hinge body 33 and an outer capping component 34, and the outer capping component 34 can be detachably connected to the hinge body 33. The first hinge component 30 can be fixed to the first tube 24. The second hinge component 32 can be fixed to the second tube 26 and rotatably connected to the first hinge component 30. The outer capping component 34 can be rigidly connected to the second hinge component 32 and configured to cap the first hinge component 30. The locking hub component 36 can be disposed on the center tube 12 and slidably located between the first hinge component 30 and the outer capping component 34. The resilient component 38 can be disposed between the first hinge component 30 and the locking hub component 36.

The first hinge component 30 can have a penetrating hole 40 where the center tube 12 passes through; therefore, an end of the center tube 12 can pass through the penetrating hole 40 to connect with the locking hub component 36. The first hinge component 30 can include at least one first tooth 42, and the second hinge component 32 can include at least one second tooth 44 located in the hinge body 33. The locking hub component 36 can include at least one third tooth 46. The third tooth 46 can be engaged between the first tooth 42 and the second tooth 44 in a movable manner when the locking hub component 36 is slid inside a space formed by the first hinge component 30 and the second hinge component 32.

In another possible embodiment, the second hinge component 32 may include the hinge body 33 and the outer capping component 34 rigidly connected to each other, and the second tooth 44 can be located in the outer capping component 34. As the second hinge component 32 is assembled with the first hinge component 30, the third tooth 46 can be slid between the first tooth 42 and the second tooth 44 for locking and unlocking relative rotation between the first hinge component 30 and the second hinge component 32.

As shown in FIG. 6, the locking hub component 36 is partially protruded from the first hinge component 30 to simultaneously engage the third tooth 46 with the first tooth 42 and the second tooth 44, so that the relative rotation between the first hinge component 30 and the second hinge component 32 is constrained; thus, the foldable bassinet apparatus 10 can be locked at an unfolding position shown in FIG. 1 and a folding position shown in FIG. 2. Further, as shown in FIG. 7, the locking hub component 36 is fully retracted into the first hinge component 30 to disengage the third tooth 46 from the second tooth 44 for allowing the relative rotation between the first hinge component 30 and the second hinge component 32. The second hinge component 32 can be freely rotated relative to the first hinge component 30 to switch between the folding position and the unfolding position. When the locking hub component 36 is fully retracted into the first hinge component 30, the resilient component 38 is compressed to store a resilient recovering force. When a retracting force applied to the locking hub component 36 is removed, the resilient recovering force can be used to push the locking hub component 36 partially out of the first hinge component 30, which means the resilient component 38 can move the locking hub component 36 toward the second hinge component 32, so as to engage the third tooth 46 with the first tooth 42 and the second tooth 44.

In the embodiment, the resilient component 38 can be, but not limited to, a compressed spiral spring. An end of the resilient component 38 abuts against an inner surface 301 of the first hinge component 30, and the other end of the resilient component 38 abuts against an inner surface 361 of the locking hub component 36. The resilient component 38 can be disposed around a protruding body 362 of the locking hub component 36, and the protruding body 362 can be a connection inserted into the center tube 12. Besides, the resilient component 38 may be disposed inside the space formed by the first hinge component 30 and the outer capping component 34, but located between the protruding body 362 and lateral walls of the first hinge component 30 and the outer capping component 34; thus, the protruding body 362 may be not sheathed by the resilient component 38.

Figure 8:
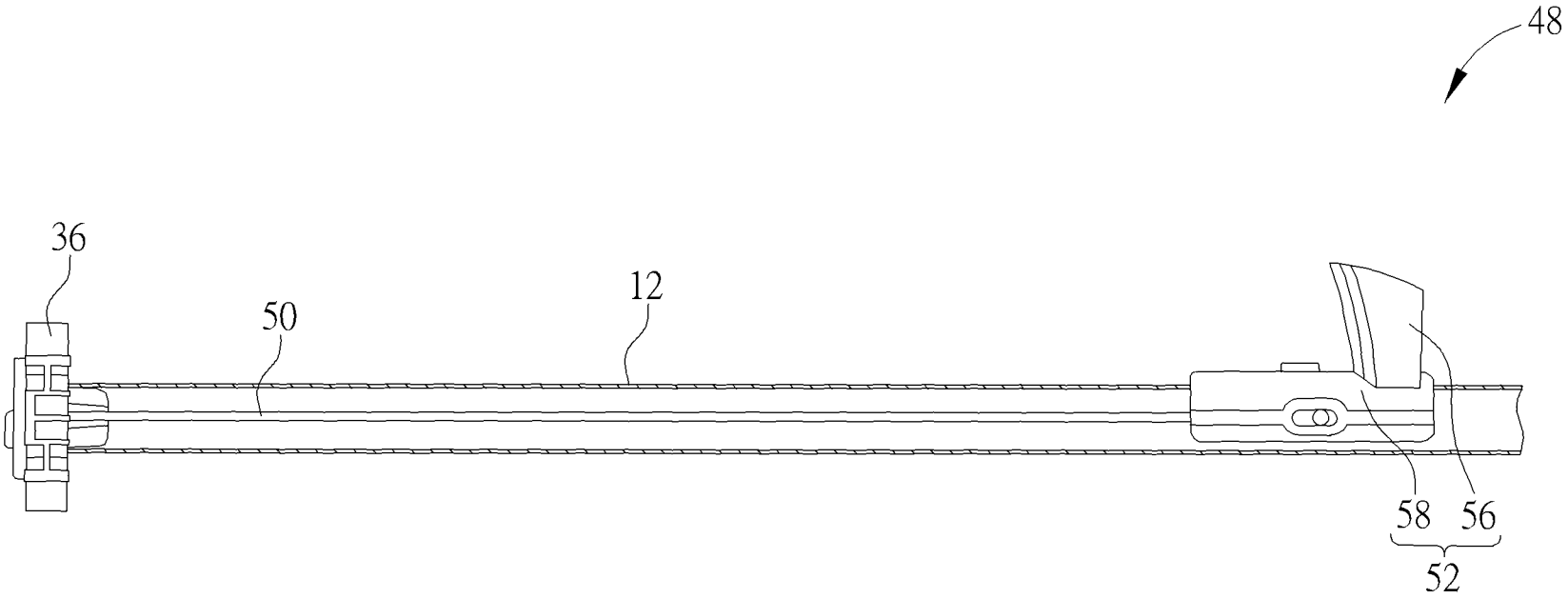
FIG. 8 and FIG. 9 are diagrams of parts of a bassinet releasing mechanism according to the embodiment of the present invention.
Figure 9:
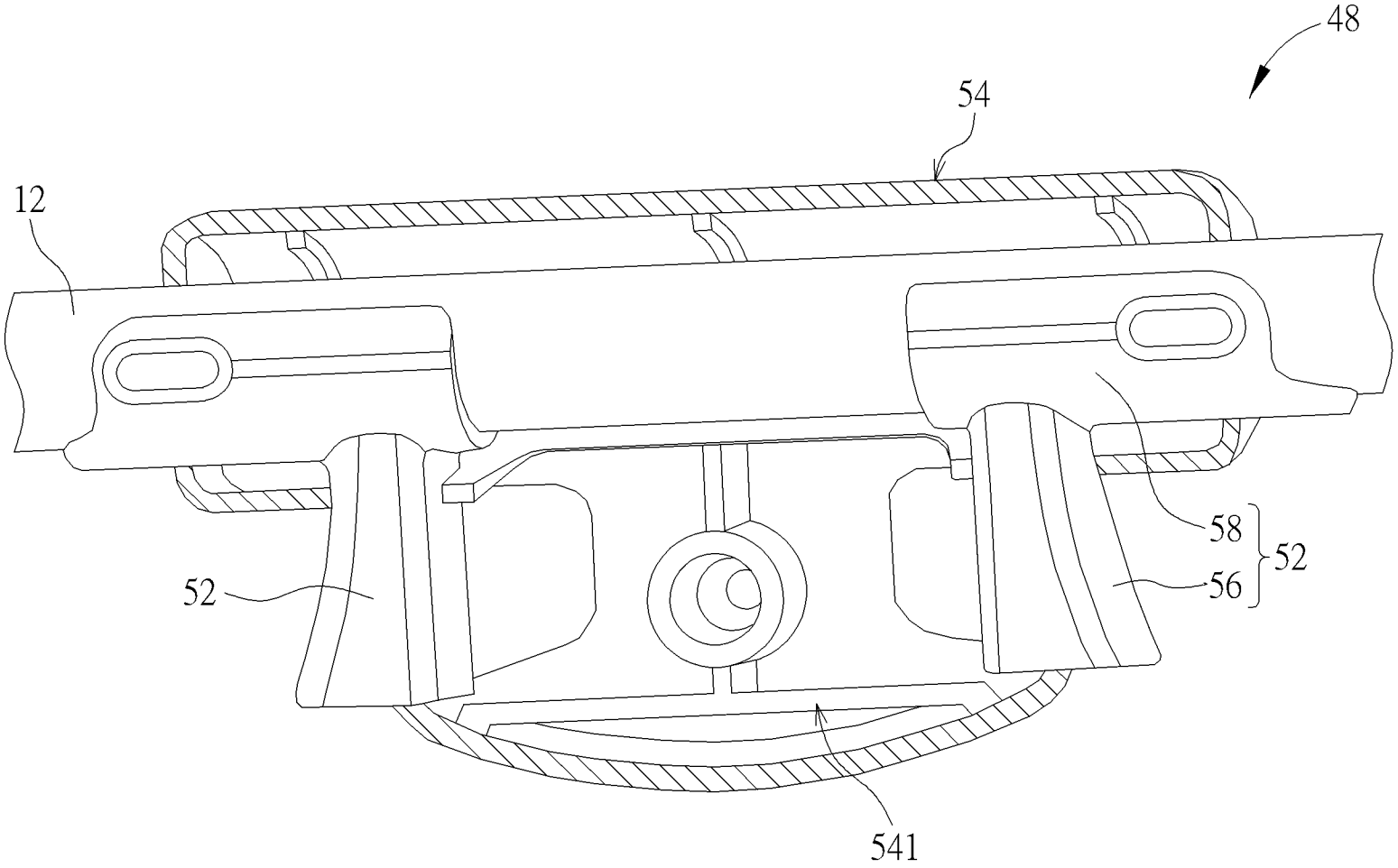
Figure 10:
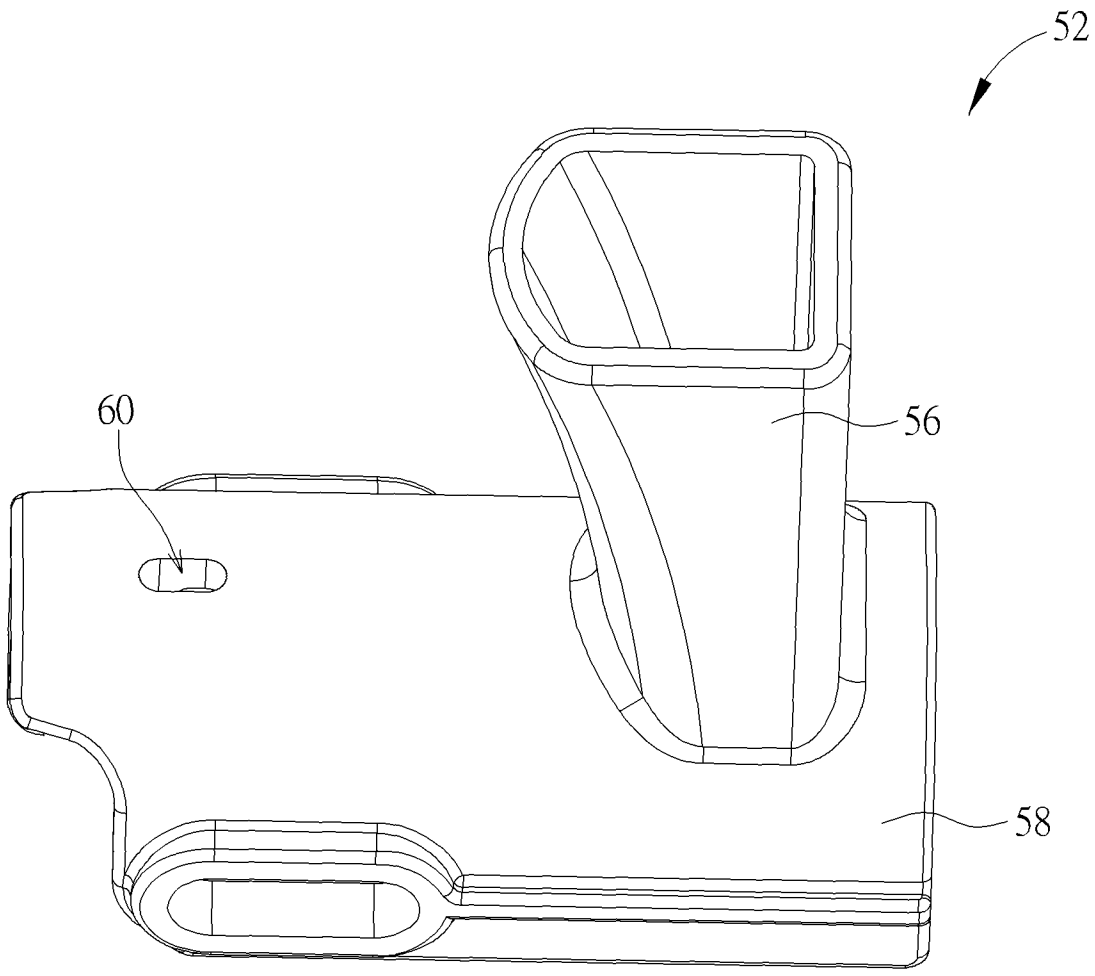
FIG. 10 and FIG. 11 are diagrams of an element of the bassinet releasing mechanism in different views according to the embodiment of the present invention.
Figure 11:
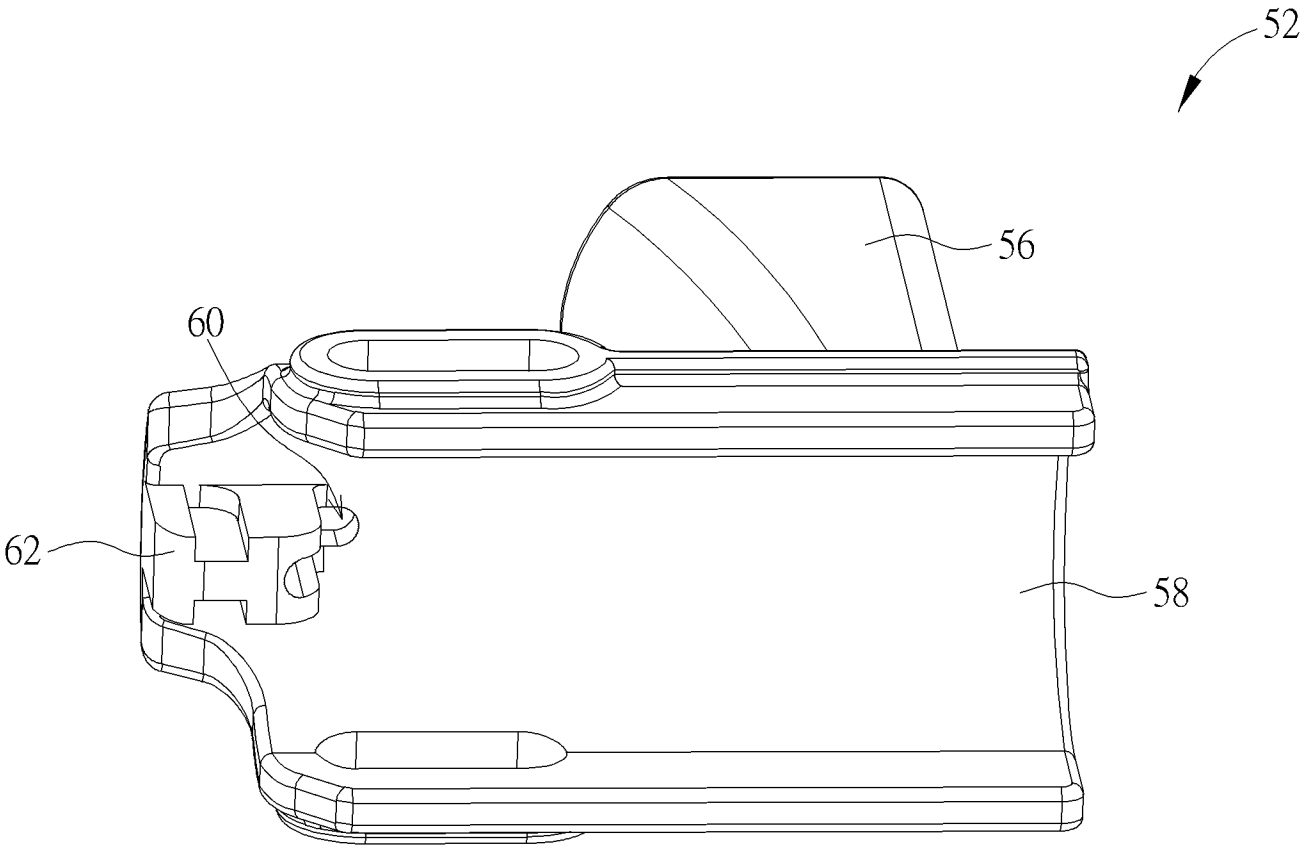

For actuating the bassinet locking mechanism 28, the center tube 12 of the foldable bassinet apparatus 10 can include a bassinet releasing mechanism 48 configured to pull the locking hub component 36 to disengage the third tooth 46 from the second tooth 44. The locking hub component 36 can be retracted into the first hinge component 30 by a variety of bassinet releasing mechanisms. In a possible embodiment, the center tube 12 may have twisting function for becoming the bassinet releasing mechanism 48; for example, the locking hub component 36 is connected to the center tube 12, and the locking hub component 36 can be retracted when the center tube 12 is twisted, so as to actuate the bassinet locking mechanism 28. In another possible embodiment, the bassinet releasing mechanism 48 is consisted of a plurality of mechanical elements. Please refer to FIG. 8 to FIG. 11. FIG. 8 and FIG. 9 are diagrams of parts of the bassinet releasing mechanism 48 according to the embodiment of the present invention. FIG. 10 and FIG. 11 are diagrams of an element of the bassinet releasing mechanism 48 in different views according to the embodiment of the present invention. The bassinet releasing mechanism 48 can include a pull wire 50, a releasing component 52, and a protecting component 54. The pull wire 50 is located inside the center tube 12. An end of the pull wire 50 is jointed with the locking hub component 36, and other end of the pull wire 50 is jointed with the releasing component 52. The releasing component 52 is configured to pull the locking hub component 36 via the pull wire 50 to retract the locking hub component 36 into the first hinge component 30.

In another possible embodiment, the first hinge component 30 may be secured to the center tube 12, and the second hinge component can be rotated relative to the center tube 12 in the counterclockwise direction. The first tube 24 fixed to the first hinge component 30 and the second tube 26 fixed to the second hinge component 32 can be relatively rotated toward each other. The first hinge component 30 secured to the center tube 12 can be used to align the bassinet releasing mechanism 48 and the pull wire 50 with a locking hub component 36 of the bassinet locking mechanism 28, so as to prevent the pull wire 50 from generating tension which results from relative rotation between the bassinet releasing mechanism 48 and the locking hub component 36.

In the embodiment, the releasing component 52 can include a handle 56 and a bushing portion 58 connected with each other. The handle 56 can be operated by a user. The bushing portion 58 can be slidably disposed on the center tube 12. An opening 60 can be formed on the bushing portion 58. A rib portion 62 can be formed on an inner of the bushing portion 58 and disposed adjacent to the opening 60. The pull wire 50 can be locked with the opening 60 and abuts against the rib portion 62. The protecting component 54 can be disposed on the center tube 12, and the handle 56 can be hidden under a shield 541 of the protecting component 54 to prevent accident touch. Therefore, the user can apply force to move the releasing component 52 toward a direction opposite to the bassinet locking mechanism 28. The bushing portion 58 of the releasing component 52 pulls the locking hub component 36 to retract into the first hinge component 30 via pull wire 50, and then the second hinge component 32 can be freely rotated relative to the first hinge component 30.

Figure 12:
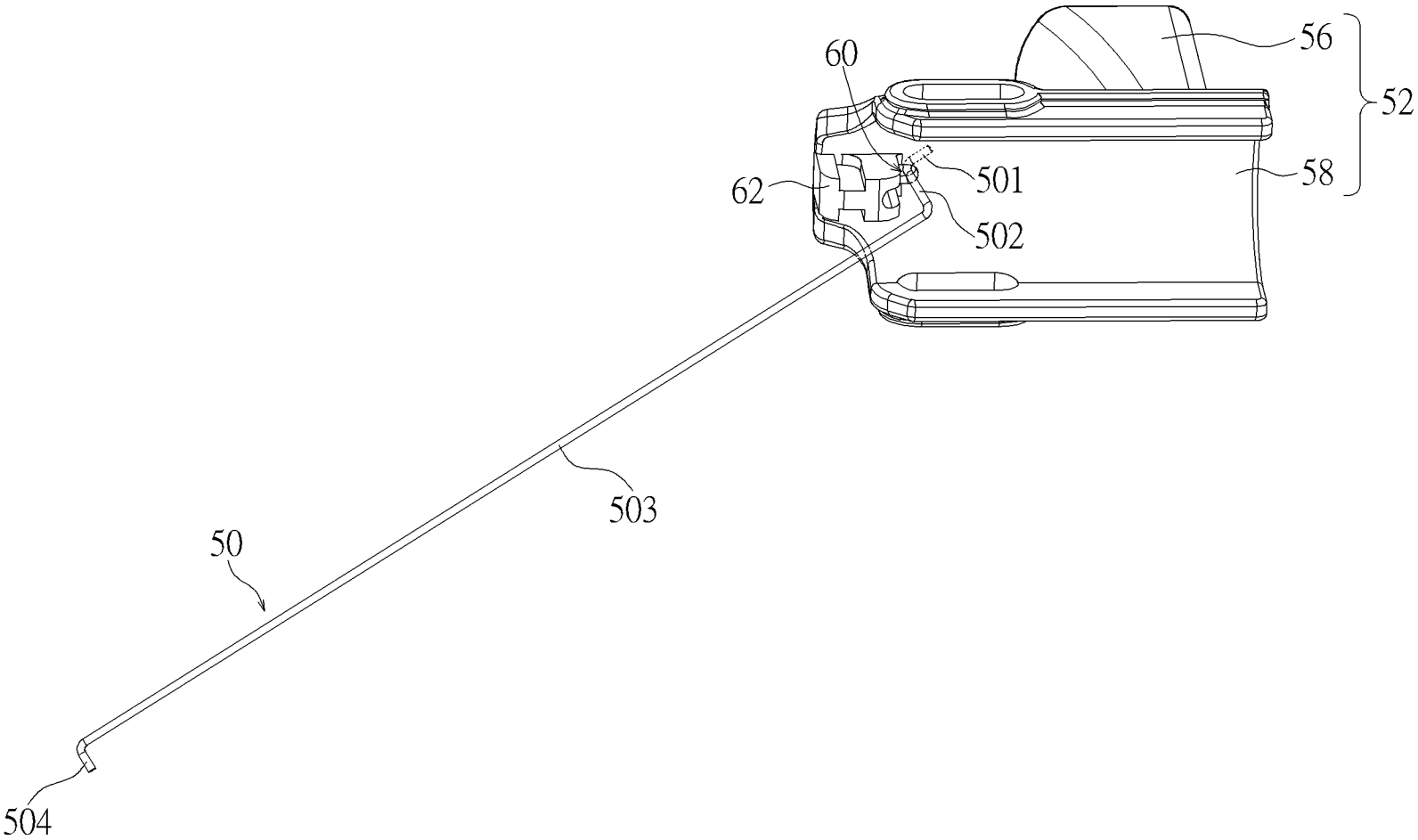
FIG. 12 and FIG. 13 respectively are diagrams of a pull wire assembled with a releasing component in different procedure according to the embodiment of the present invention.
Figure 13:
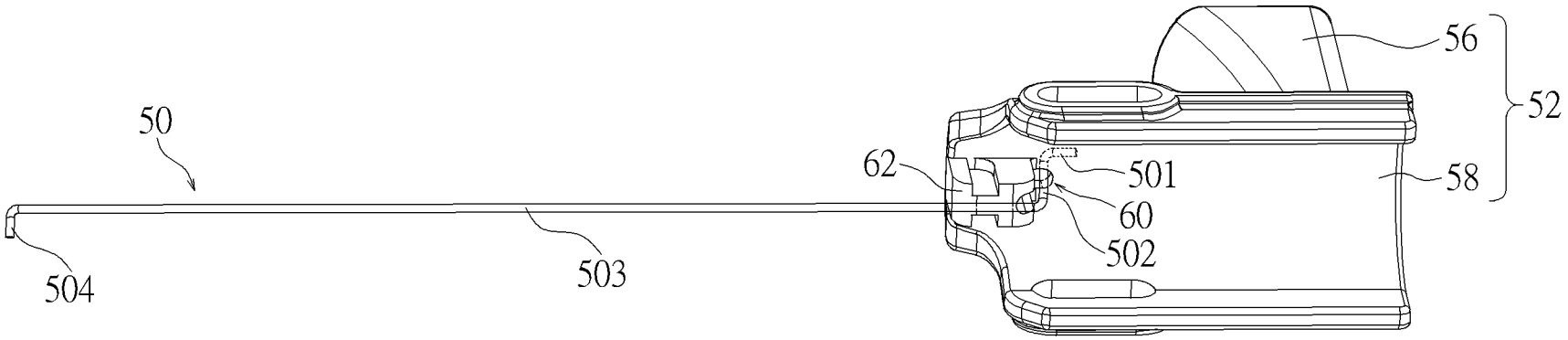

Please refer to FIG. 12 and FIG. 13. FIG. 12 and FIG. 13 respectively are diagrams of the pull wire 50 assembled with the releasing component 52 in different procedure according to the embodiment of the present invention. As shown in FIG. 12, the pull wire 50 has a first section 501, a second section 502, a third section 503 and a fourth section 504 connected to each other. The first section 501 and the fourth section 504 are ends of the pull wire 50. The third section 503 is bent from the fourth section 504. The second section 502 is bent from the first section 501 and the third section 503, and therefore the first section 501 may be parallel to the third section 503. The first section 501 can be obliquely inserted into the opening 60 from the inner of the bushing portion 58 for a start, as shown in FIG. 12; then, the third section 503 can be rotated to abut the second section 502 against a slot on the rib portion 62, so as to support the pull wire 50 by the rib portion 62, as shown in FIG. 13.

Figure 14:
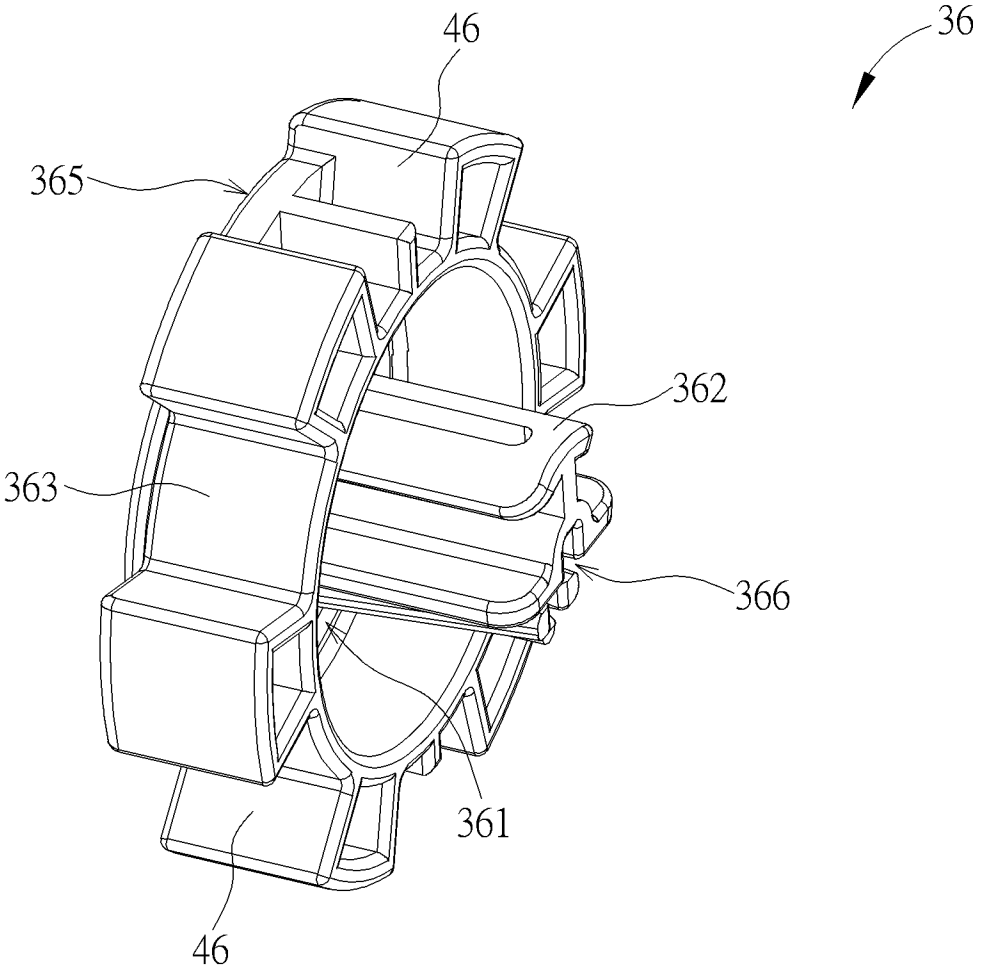
FIG. 14 is a diagram of a locking hub component according to the embodiment of the present invention.
Figure 15:
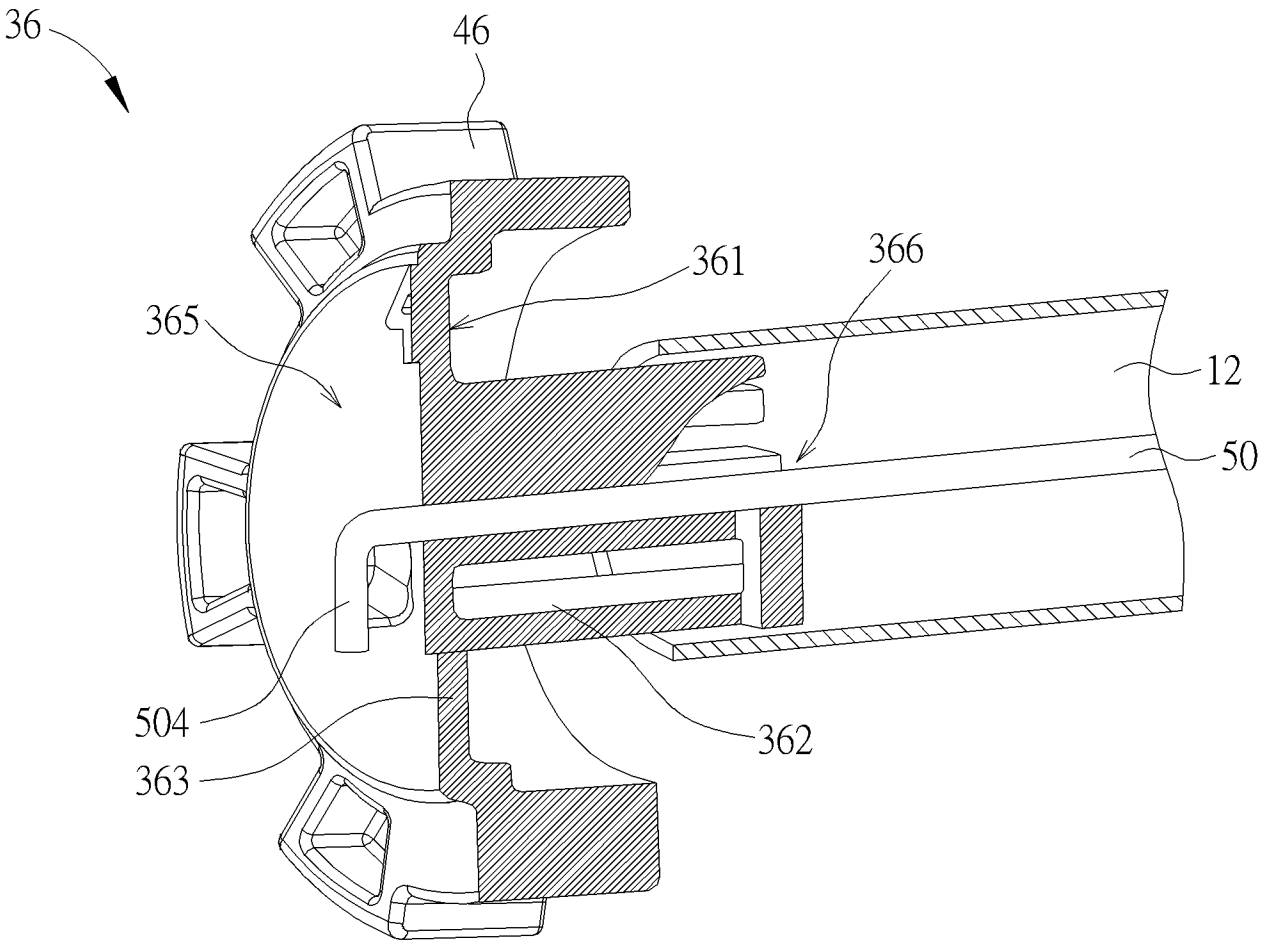
FIG. 15 to FIG. 17 respectively are diagrams of the pull wire being assembled with the locking hub component in different procedure according to the embodiment of the present invention.
Figure 16:
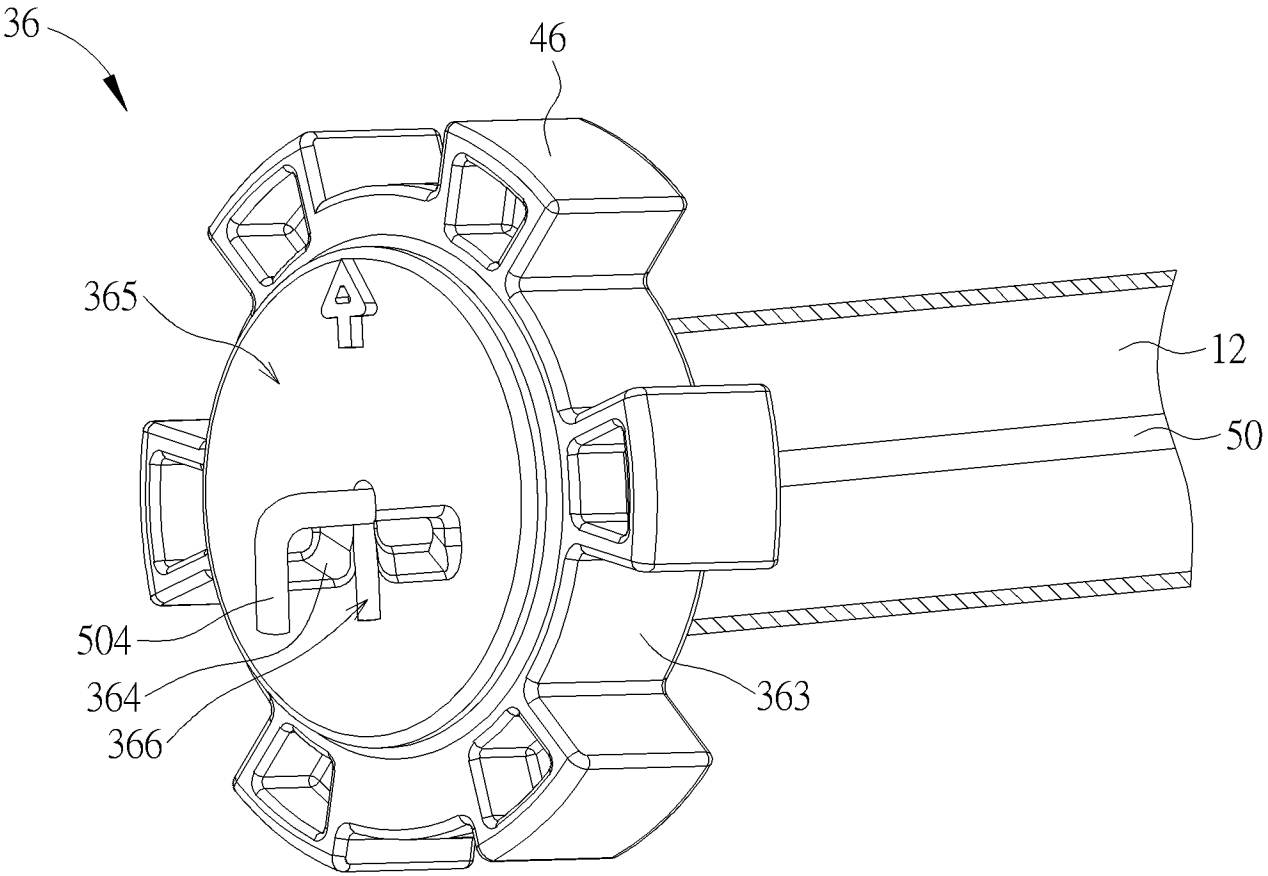
Figure 17:
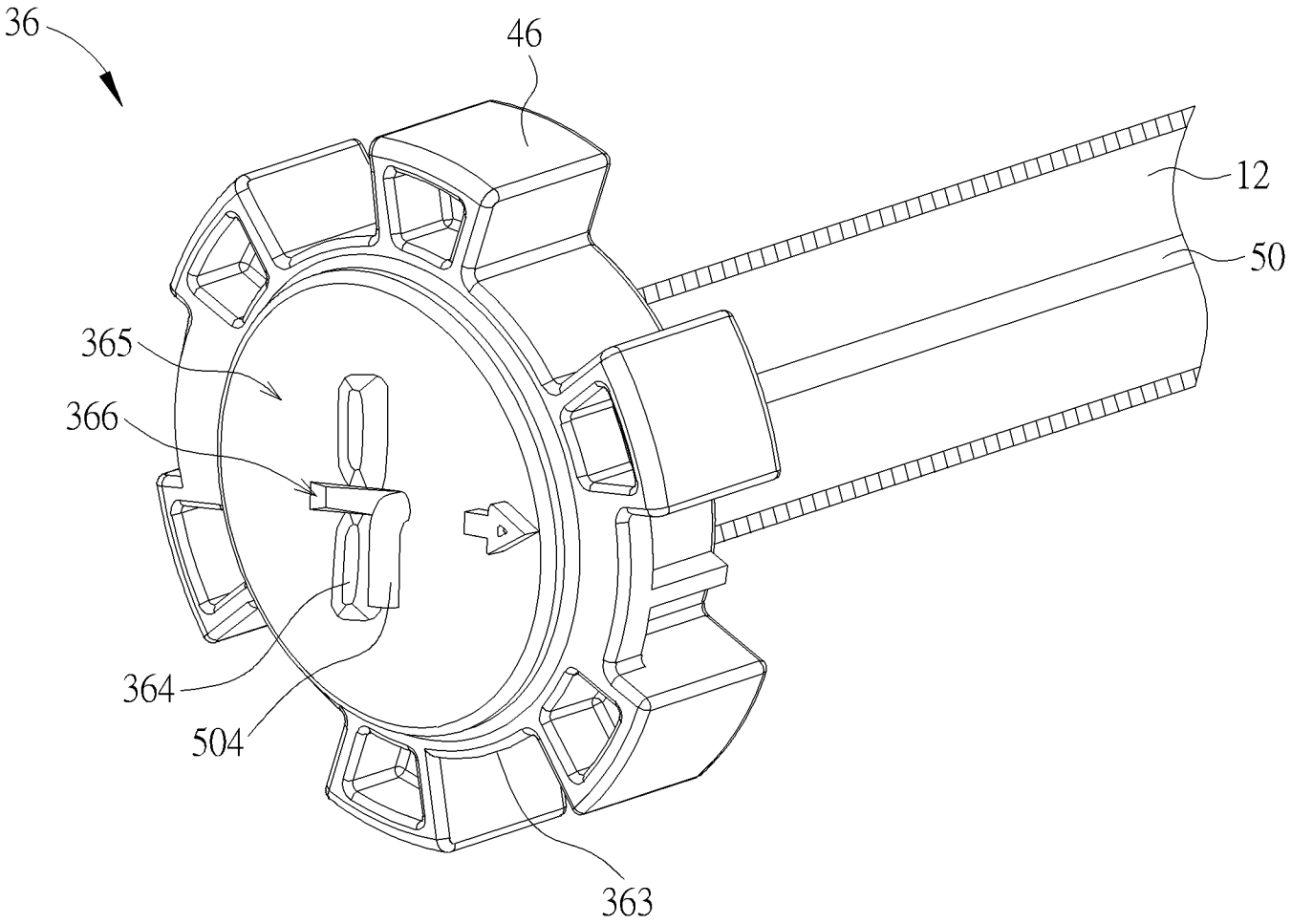

Please refer to FIG. 12 to FIG. 17. FIG. 14 is a diagram of the locking hub component 36 according to the embodiment of the present invention. FIG. 15 to FIG. 17 respectively are diagrams of the pull wire 50 being assembled with the locking hub component 36 in different procedure according to the embodiment of the present invention. The locking hub component 36 can further include a main body 363 and a retaining rib 364. The protruding body 362 and the retaining rib 364 are respectively disposed on a first surface (such as the inner surface 361) and a second surface (such as an outer surface 365) of the main body 363 opposite to each other; it should be particularly mentioned that the third tooth 46 are disposed on an edge of the main body 363.

The main body 363 and the protruding body 362 can have a channel 366 therebetween. As shown in FIG. 15, the other end (the fourth section 504) of the pull wire 50 can pass through the channel 366 to reach the second surface (the outer surface 365), and the third section 503 can be supported by the protruding body 362. As shown in FIG. 16, the locking hub component 36 can be fully slid into the center tube 12 until the fourth section 504 of the pull wire 50 extends over the retaining rib 364 and the outer surface 365. As shown in FIG. 17, the locking hub component 36 can be rotated to a specific degree (such as ninety degrees), thereby abutting the fourth section 504 against the retaining rib 364 for securing the locking hub component 36 and the pull wire 50 together.

Figure 18:
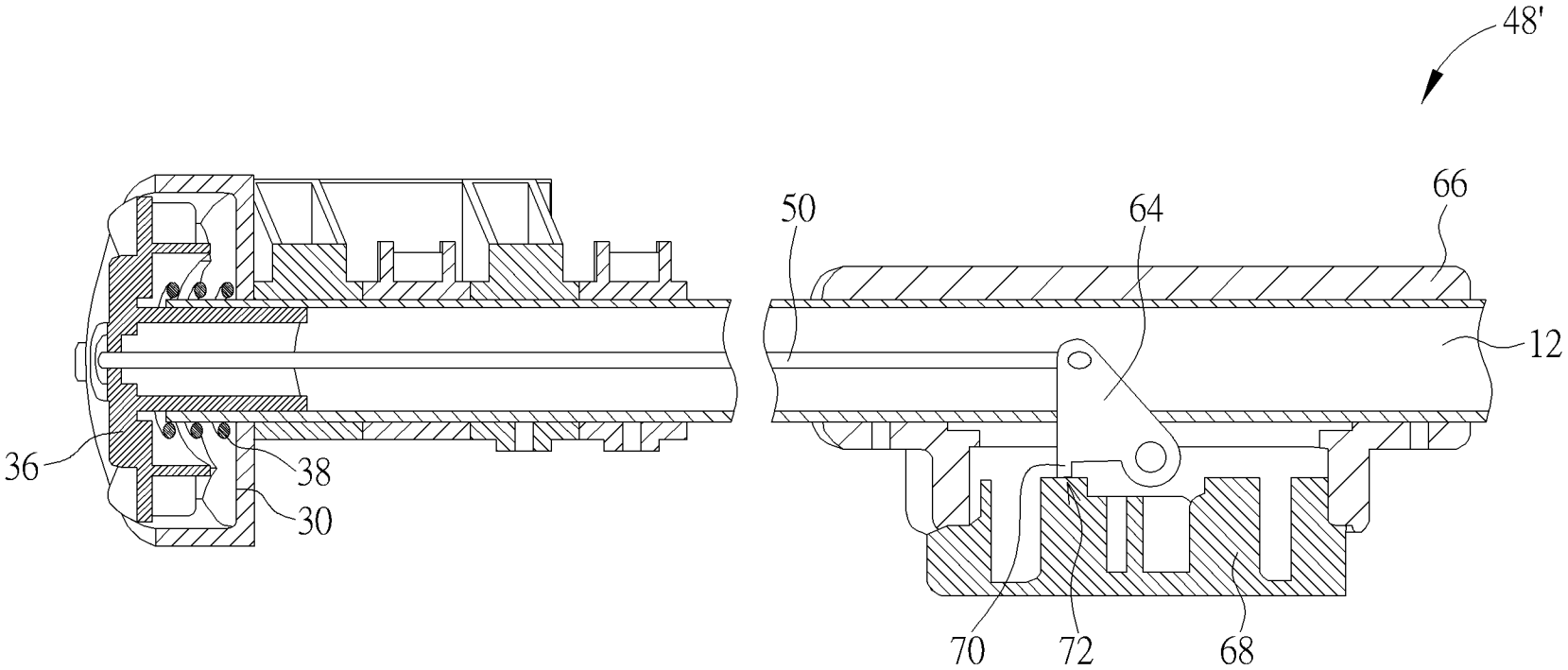
FIG. 18 and FIG. 19 respectively are diagrams of the bassinet releasing mechanism in different procedure according to other embodiment of the present invention.
Figure 19:
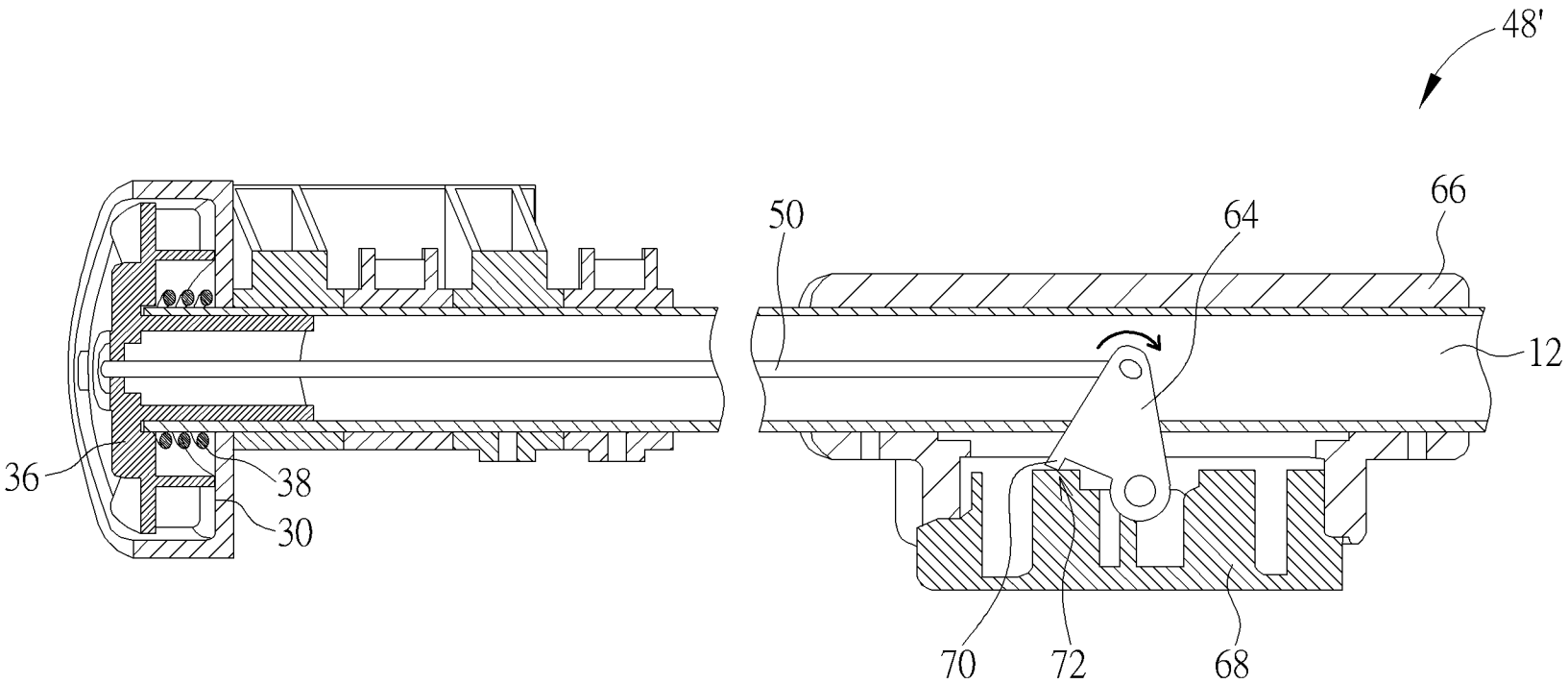

Please refer to FIG. 18 and FIG. 19. FIG. 18 and FIG. 19 respectively are diagrams of the bassinet releasing mechanism 48' in different procedure according to other embodiment of the present invention. In the embodiment, elements having the same numerals as one of the foresaid embodiment have the same structures and functions, and a detailed description is omitted herein for simplicity. The bassinet releasing mechanism 48' can include the pull wire 50, a releasing component 64, a handle 66 and a pressing component 68. The pull wire 50 can be located inside the center tube 12. Two ends of the pull wire 50 can be respectively jointed with the locking hub component 36 and the releasing component 64. The releasing component 64 can be rotatably disposed on the handle 66, and the handle 66 can be disposed on the center tube 12. Further, the pressing component 68 can be movably disposed on the handle 66 and configured to drive rotary motion of the releasing component 64.

The releasing component 64 can be a rotary plate and includes a protruding portion 70 configured to detachably contact against a bearing surface 72 of the pressing component 68. As shown in FIG. 18, the resilient component 38 moves the locking hub component 36 away from the first hinge component 30. The pull wire 50 is tightened by the locking hub component 36, and the protruding portion 70 can push the bearing surface 72 to move the pressing component 68 out of the handle 66. As shown in FIG. 19, the pressing component 68 can be linearly slid relative to the handle 66 when being pressed by the user. The bearing surface 72 pushes the protruding portion 70, and the releasing component 64 can be rotated relative to the handle 66 in a clockwise direction via contact between the bearing surface 72 and the protruding portion 70. The releasing component 64 can pull the pull wire 50 to retract the locking hub component 36 into the first hinge component 30, which means the third tooth 46 of the locking hub component 36 are disengaged from the second tooth 44 of the outer capping component 34.

In conclusion, the supporting tubes of each frame of the foldable bassinet apparatus can be folded and unfolded via the connection module and the linkage mechanisms. The connection module utilizes the bassinet locking mechanism to adjust relative motion between the first tube and the second tube. The bassinet locking mechanism has the locking hub component slidably disposed between the first hinge component (which is fixed to the first tube) and the outer capping component (which is rigidly connected to the second hinge component fixed to the second tube). Rotation of the first hinge component and the second hinge component can be constrained when the locking hub component assembled with the first hinge component is further engaged with the outer capping component; in addition, the foresaid rotation can be allowed when the locking hub component is disengaged from the outer capping component.

The foldable bassinet apparatus utilizes the bassinet releasing mechanism disposed on the center tube to actuate the bassinet locking mechanism. When the releasing component is operated, the releasing component can pull the locking hub component to retract into the first hinge component via the pull wire; besides, the locking hub component can be moved out of the first hinge component by the resilient component when an external force applied to the releasing component is removed. The releasing component can be directly pushed by the user or indirectly pressed via the pressing component, so as to disengage the locking hub component from the outer capping component. Comparing to the prior art, the present invention, the bassinet locking mechanism and the bassinet releasing mechanism have advantages of simple structures and convenient operation, so that the related foldable bassinet apparatus can be easily folded and unfolded to minimize the volume for storage.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A foldable bassinet apparatus, comprising:

a center tube;

at least two frames; and at least two connection modules disposed on a corresponding frame, the center tube being connected between the connection modules, at least one of the connection modules comprising a bassinet locking mechanism, a first tube and a second tube, the bassinet locking mechanism comprising:

a first hinge component fixed to the first tube, the first hinge component having a penetrating hole where the center tube passes through;

a second hinge component fixed to the second tube and rotatably connected to the first hinge component; and a locking hub component disposed on the center tube and slidably located between the first hinge component and the second hinge component;

wherein when the bassinet locking mechanism is unlocked, the center tube is able to move upward and the foldable bassinet apparatus moves from an unfolding position to a folding position.

2. The foldable bassinet apparatus of claim 1, wherein the locking hub component being fully retracted into the first hinge component to allow relative rotation between the first hinge component and the second hinge component for folding and unfolding the foldable bassinet apparatus, and being further partially protruded from the first hinge component to constrain the relative rotation for locking modes of the foldable bassinet apparatus.

3. The foldable bassinet apparatus of claim 1, wherein the first hinge component comprises at least one first tooth, the second hinge component comprises at least one second tooth, and the locking hub component comprises at least one third tooth engaged between the at least one first tooth and the at least one second tooth to constrain the relative rotation.

4. The foldable bassinet apparatus of claim 3, wherein while the locking hub component is fully retracted into the first hinge component, the at least one third tooth is disengaged from the second tooth, allowing the relative rotation between the first hinge component and the second hinge component for folding and unfolding the foldable bassinet apparatus; and while the locking hub component is partially protruded from the first hinge component, the at least one third tooth is engaged with the first tooth and the second tooth to constrain the relative rotation for locking modes of the foldable bassinet apparatus.

5. The foldable bassinet apparatus of claim 1, wherein the bassinet locking mechanism further comprises a resilient component disposed between the first hinge component and the locking hub component, a resilient recovering force of the resilient component is used to move the locking hub component toward the second hinge component.

6. The foldable bassinet apparatus of claim 5, wherein the resilient component is a compressed spiral spring, an end of the compressed spiral spring abuts against an inner surface of the first hinge component, and the other end of the compressed spiral spring is disposed on a protruding body of the locking hub component.

7. The foldable bassinet apparatus of claim 1, wherein the center tube comprises a bassinet releasing mechanism connected to the bassinet locking mechanism and the bassinet releasing mechanism comprises:

a pull wire located inside the center tube, an end of the pull wire being jointed with the locking hub component; and a releasing component jointed with the other end of the pull wire, the releasing component being actuated to pull the locking hub component via the pull wire to retract the locking hub component into the first hinge component.

8. The foldable bassinet apparatus of claim 7, wherein the bassinet releasing mechanism further comprises a handle and a pressing component, the handle is disposed on the center tube, the pressing component is movably disposed on the handle and configured to drive motion of the releasing component.

9. The foldable bassinet apparatus of claim 7, wherein the releasing component is a rotary plate rotatably disposed on the handle and contacting against the pressing component.

10. The foldable bassinet apparatus of claim 7, wherein the releasing component comprises a handle and a bushing portion connected with each other, the bushing portion is slidably disposed on the center tube, an opening is formed on the bushing portion and a rib portion is disposed adjacent by the opening, the pull wire is locked with the opening and abuts against the rib portion.

11. The foldable bassinet apparatus of claim 7, wherein the locking hub component comprises a main body, a protruding body and a retaining rib, the protruding body and the retaining rib are respectively disposed on a first surface and a second surface of the main body opposite to each other.

12. The foldable bassinet apparatus of claim 11, wherein the pull wire passes through a channel formed between the main body and the protruding body, and is reached to the second surface to abut against the retaining rib.

* * * * *